US005782042A

United States Patent [19]

Klein

[11] Patent Number: 5,782,042

[45] Date of Patent: Jul. 21, 1998

[54] TILTING POLE SYSTEM

[76] Inventor: Erwin M. Klein, 3219 Spring Cypress Rd., Spring, Tex. 77388

[21] Appl. No.: 791,663

[22] Filed: Jan. 30, 1997

[51] Int. Cl.[6] ..... B66C 23/06

[52] U.S. Cl. ..... 52/116; 52/120

[58] Field of Search ..... 52/69, 110, 114, 52/116, 119, 120, 40; 343/890, 874

[56] References Cited

U.S. PATENT DOCUMENTS

| | | | |
|---|---|---|---|
| 2,214,685 | 9/1940 | Stone, Jr. | 52/110 X |
| 2,822,066 | 2/1958 | Hanson | 52/120 X |
| 4,149,347 | 4/1979 | Boemer | 52/116 |
| 5,572,836 | 11/1996 | Parker | 52/116 |

*Primary Examiner*—Creighton Smith

[57] ABSTRACT

A new Tilting Pole System for allowing an individual to quickly and easily perform maintenance upon an object conventionally supported by an elongated pole. The inventive device includes a lower pole, an upper pole pivotally secured to a top end of the lower pole by a hinge, a shaft rotatably projects within a capped end of the upper pole, and a fastener removably projects through a lower portion of the lower and the upper poles. The fastener is removed when tilting the upper pole with respect to the lower pole. The shaft secures a utility device such as an antenna, a flag, a satellite dish or a lamp. An electrical outlet is secured to the lower portion of the lower pole for providing electrical power to various electric tools in a remote area.

17 Claims, 3 Drawing Sheets

TILTING POLE SYSTEM

BACKGROUND OF THE INVENTION

1. Field of the Invention

The present invention relates to Pole Devices and more particularly pertains to a new Tilting Pole System for allowing an individual to quickly and easily perform maintenance upon an object conventionally supported by an elongated pole.

2. Description of the Prior Art

The use of Pole Devices is known in the prior art. More specifically, Pole Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Pole Devices include U.S. Pat. No. 4,079,559; U.S. Pat. No. 3,941,083; U.S. Pat. No. 4,515,241; U.S. Design Pat. No. 327,454; U.S. Pat. No. 4,662,305 and U.S. Pat. No. 4,619,220.

While these devices fulfill their respective, particular objectives and requirements, the aforementioned patents do not disclose a new Tilting Pole System. The inventive device includes a lower pole, an upper pole pivotally secured to a top end of the lower pole by a hinge, a shaft rotatably projects within a capped end of the upper pole, and a fastener removably projects through a lower portion of the lower and the upper poles.

In these respects, the Tilting Pole System according to the present invention substantially departs from the conventional concepts and designs of the prior art, and in so doing provides an apparatus primarily developed for the purpose of allowing an individual to quickly and easily perform maintenance upon an object conventionally supported by an elongated pole.

SUMMARY OF THE INVENTION

In view of the foregoing disadvantages inherent in the known types of Pole Devices now present in the prior art, the present invention provides a new Tilting Pole System construction wherein the same can be utilized for allowing an individual to quickly and easily perform maintenance upon an object conventionally supported by an elongated pole.

The general purpose of the present invention, which will be described subsequently in greater detail, is to provide a new Tilting Pole System apparatus and method which has many of the advantages of the Pole Devices mentioned heretofore and many novel features that result in a new Tilting Pole System which is not anticipated, rendered obvious, suggested, or even implied by any of the prior art Pole Devices, either alone or in any combination thereof.

To attain this, the present invention generally comprises a lower pole, an upper pole pivotally secured to a top end of the lower pole by a hinge, a shaft rotatably projects within a capped end of the upper pole, and a fastener removably projects through a lower portion of the lower and the upper poles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Tilting Pole System apparatus and method which has many of the advantages of the Pole Devices mentioned heretofore and many novel features that result in a new Tilting Pole System which is not anticipated, rendered obvious, suggested, or even implied by any of the prior art Pole Devices, either alone or in any combination thereof.

It is another object of the present invention to provide a new Tilting Pole System which may be easily and efficiently manufactured and marketed.

It is a further object of the present invention to provide a new Tilting Pole System which is of a durable and reliable construction.

An even further object of the present invention is to provide a new Tilting Pole System which is susceptible of a low cost of manufacture with regard to both materials and labor, and which accordingly is then susceptible of low prices of sale to the consuming public, thereby making such Tilting Pole System economically available to the buying public.

Still yet another object of the present invention is to provide a new Tilting Pole System which provides in the apparatuses and methods of the prior art some of the advantages thereof, while simultaneously overcoming some of the disadvantages normally associated therewith.

Still another object of the present invention is to provide a new Tilting Pole System for allowing an individual to quickly and easily perform maintenance upon an object conventionally supported by an elongated pole.

Yet another object of the present invention is to provide a new Tilting Pole System which includes a lower pole, an upper pole pivotally secured to a top end of the lower pole by a hinge, a shaft rotatably projects within a capped end of the upper pole, and a fastener removably projects through a lower portion of the lower and the upper poles.

Still yet another object of the present invention is to provide a new Tilting Pole System that eliminates the need for a ladder or bucket truck for performing maintenance upon a pole.

Even still another object of the present invention is to provide a new Tilting Pole System that supports lights, flags, antennas and satellite dishes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
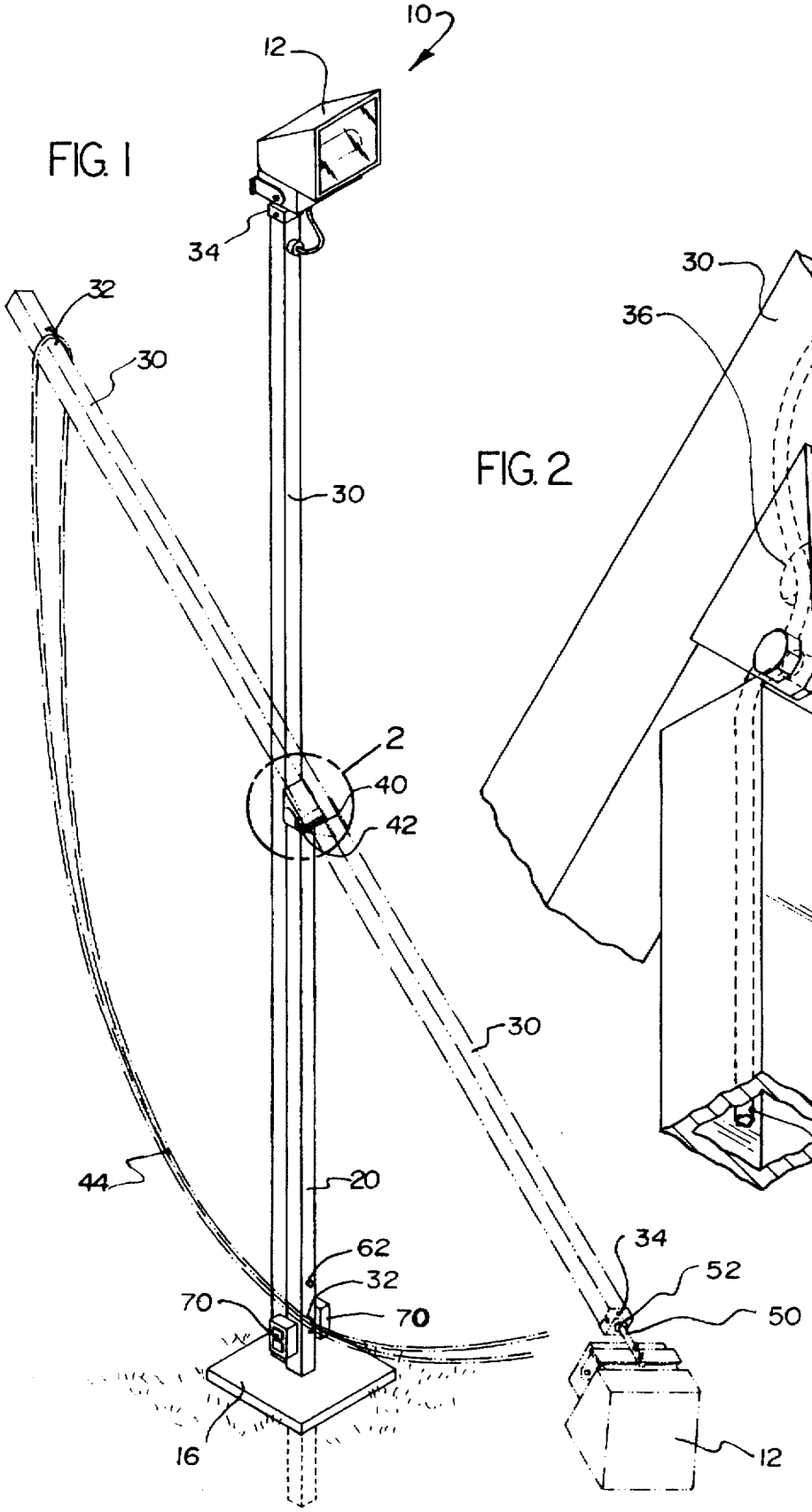
FIG. 1 is an upper perspective view of a new Tilting Pole System according to the present invention.

With reference now to the drawings, and in particular to FIGS. 1 through 5 thereof, a new Tilting Pole System embodying the principles and concepts of the present invention and generally designated by the reference numeral 10 will be described.

More specifically, it will be noted that the Tilting Pole System 10 comprises a lower pole 20, an upper pole 30, a hinge 40, and a securing means 60.

Figure 2:
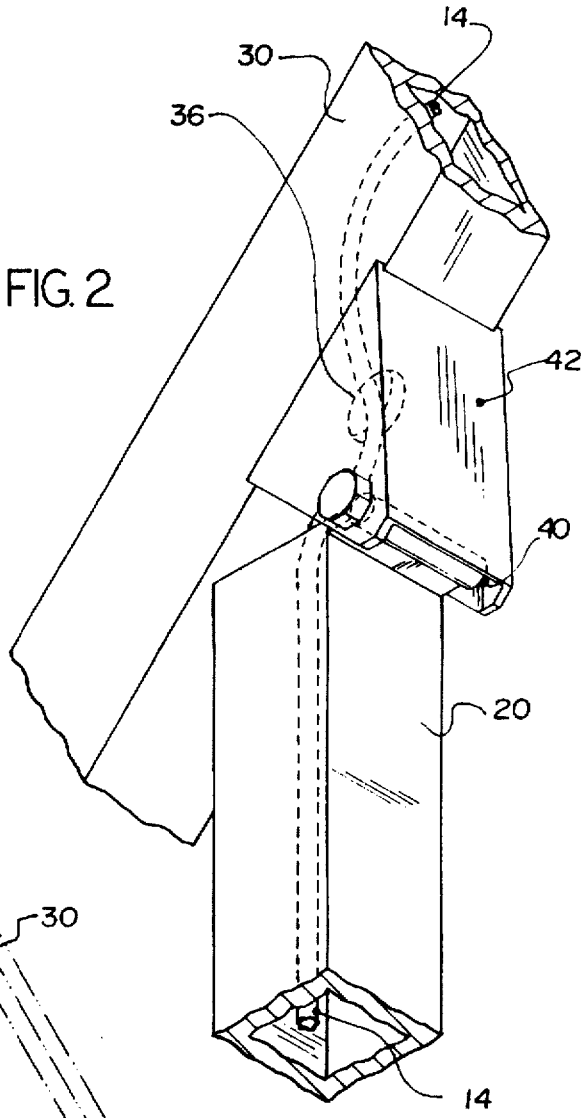
FIG. 2 is a magnified view from FIG. 1 disclosing the hinge.
Figure 3:
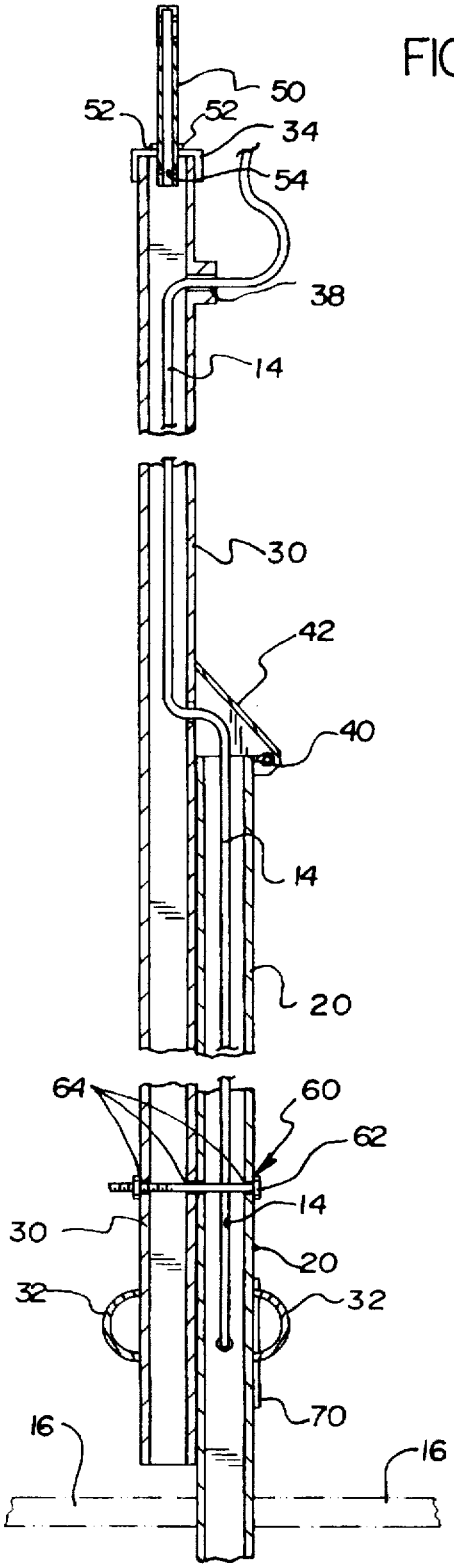
FIG. 3 is a side cut-away view of the present invention.
Figure 4:
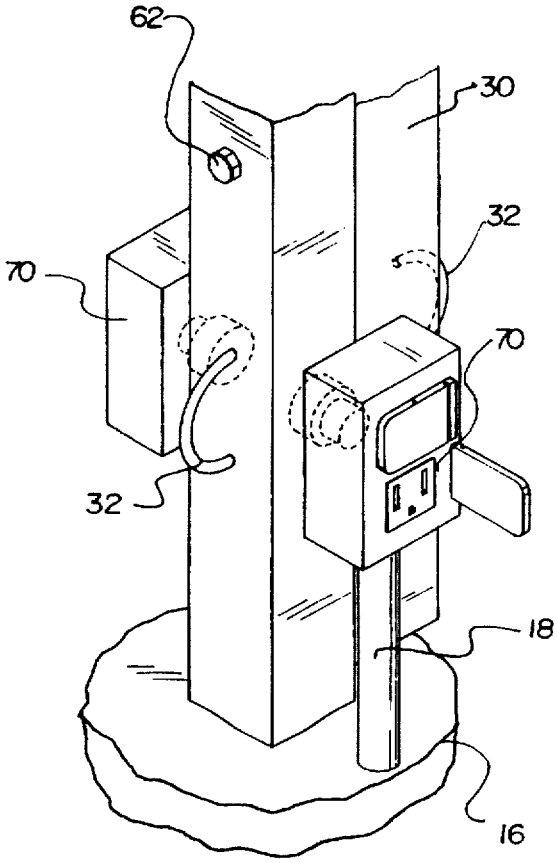
FIG. 4 is magnified perspective view of the electrical outlets.
Figure 5:
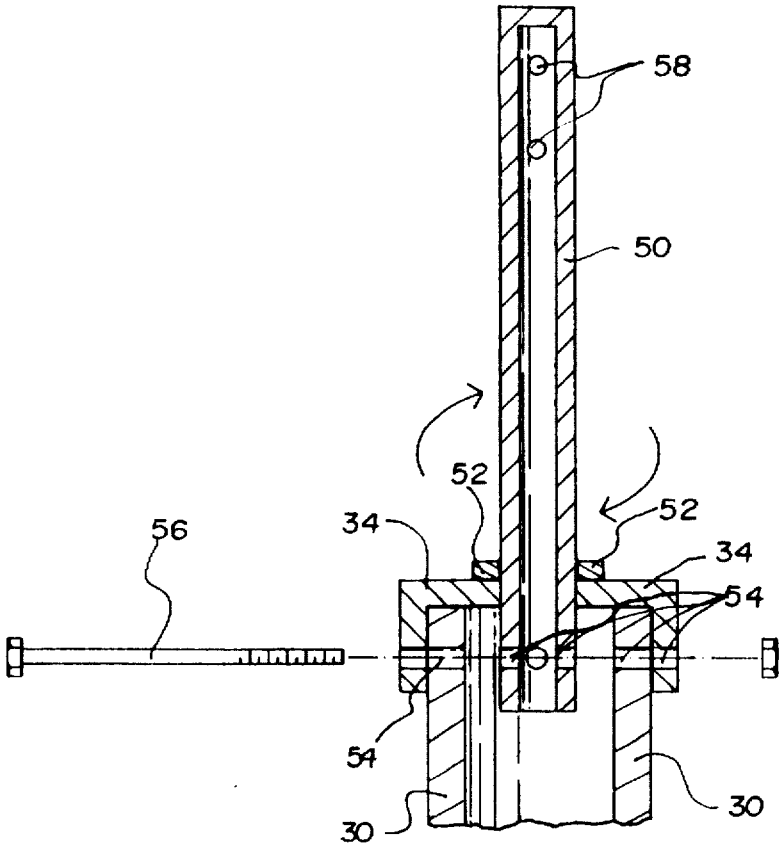
FIG. 5 is a magnified view from FIG. 3 disclosing the shaft and cap.

As shown in FIGS. 1 through 4 of the drawings, the lower pole 20 has an upper end and a lower end, wherein the lower end is for securing within concrete 16 for retaining the lower pole 20 orthogonal to ground. The upper pole 30 has a first end, a second end and a concentric portion, wherein the first end is for supporting a utility device 12 such as a lamp 12, a flag, an antenna, a satellite dish or various other devices. The upper pole 30 is preferably a finite distance longer than the lower pole 20. The concentric portion of the upper pole 30 is pivotally attached to the upper end of the lower pole 20 as shown in FIGS. 1 through 3 of the drawings. A hollow semi-triangular member 42 is secured to the concentric portion of the upper pole 30 thereby dividing the upper pole 30 into an upper portion and a lower portion as shown in FIGS. 1 through 3. The upper portion is preferably longer than the lower portion and the lower portion is substantially equal in length to the lower pole 20 as best shown in FIG. 1 of the drawings. A hinge 40 is secured to the hollow semi-triangular member 42 opposite of the upper pole 30. And the hinge is secured to the upper end of the lower pole 20 for allowing pivoting of the upper pole 30 with respect to the lower pole 20 as shown in FIGS. 1 and 2. As shown in FIGS. 1, 3 and 5, a cap 34 is secured to the first end of the upper pole 30 for preventing infiltration of a lumen of the upper pole 30 with debris.

As shown in FIG. 2 of the drawings, the upper pole 30 includes a cord aperture 36 in aposition to the hollow semi-triangular member 42 for receiving a length of electric cord 14 projecting from a lumen within the lower pole 20 and allowing the electric cord 14 to project through the lumen of the upper pole 30. The upper pole 30 includes an upper aperture 38 adjacent the first end for allowing the electric cord 14 to project through and electrically engage the utility device 12 as shown in FIG. 3 of the drawings. Preferably, as shown in FIGS. 1 and 4 of the drawings, at least one electric outlet is secured to the lower pole 20 adjacent the lower end and electrically connected to the electric cord 14 for supplying electricity within a remote area. A length of conduit projects through the concrete 16 and connects to the electrical outlet 70 for allowing the electric cord 14 to project within from a transformer.

As shown in FIGS. 1, 3 and 4 of the drawings, an eyelet 32 is secured to the lower end of the lower pole 20 and another eyelet 32 is secured to the second end of the upper pole 30. An elongated strap 44 is secured mesially the eyelets 32 for preventing the utility device 12 secured to the first end of the upper pole 30 from engaging the ground when the securing means 60 is removed.

The securing means 60 is included for removably securing the second end of the upper pole 30 to the lower end of the lower pole 20 to retain the upper pole 30 juxtaposed and parallel to the lower pole 20 as best shown in FIG. 3 of the drawings. A securing aperture 64 projects through the lower pole 20 adjacent the lower end and projects correspondingly through the upper pole 30 adjacent the second end as best shown in FIG. 3 of the drawings. A securing fastener 62 removably projects within the securing aperture 64 for retaining the second end of the upper pole 30 adjacent the lower end of the lower pole 20.

As shown in FIGS. 3 and 5, a shaft 50 has a flange 52 near a rotating end. The shaft 50 is for supporting the utility device 12 opposite of the rotating end. The rotating end rotatably projects within the cap 34 as shown in FIG. 5 of the drawings. The shaft 50 is positioned coaxial with the upper pole 30 and the flange 52 is juxtaposed to the cap 34 for preventing the shaft 50 from descending into the upper pole 30. The shaft 50 includes at least two utility attachment apertures 58 traverse to upper pole 30 for receiving fasteners 56 for securing the utility device 12. The shaft 50 includes a plurality of alignment apertures 54 adjacent the rotating end as shown in FIGS. 3 and 5 of the drawings. The alignment apertures 54 radially project through the shaft 50 and receive a fastener 56 projecting through apertures within the upper pole 30 adjacent the first end for locking the shaft 50 and the utility device 12 into a desired position.

In use, the securing fastener 62 is removed allowing the upper pole 30 to pivot upon the lower pole 20. The user grasps the elongated strap 44 to oppose the rotation of the upper pole. When the elongated strap 44 is tensioned mesial the lower pole 20 and the upper pole 30, the first end of the upper pole 30 is a convenient distance above the ground for allowing the user to perform maintenance upon the utility device 12. When the user is finished, he or she simply grasps the elongated strap 44 and pulls upon the elongated strap 44 to descend the second end of the upper pole 30. The user thereafter manipulates the upper pole 30 manually until the upper pole 30 is juxtaposed to and parallel to the lower pole 20 thereby aligning the securing apertures 64. The user inserts the securing fastener 62 into the securing apertures 64 to prevent the upper pole 30 from pivoting upon the lower pole.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tilting pole system comprising:

a lower pole having an upper end and a lower end, wherein said lower end is for securing within concrete for retaining said lower pole orthogonal to ground;

an upper pole having a first end, a second end and a concentric portion, wherein said first end is for supporting a utility device and said upper pole is a finite distance longer than said lower pole;

said concentric portion of said upper pole is pivotally attached to said upper end of said lower pole;

a securing means removably securing said second end of said upper pole to said lower end of said lower pole to retain said upper pole juxtaposed and parallel to said lower pole;

an eyelet secured to said lower end of said lower pole and another eyelet secured to said second end of said upper pole; and an elongated strap having opposing ends secured between said eyelets secured to said lower end and said second end for preventing said utility device secured to said first end of said upper pole from engaging said ground when said securing means is removed.

2. The tilting pole system of claim 1, including a cap secured to said first end of said upper pole for preventing infiltration of a lumen of said upper pole with debris.

3. The tilting pole system of claim 1, including:

a hollow semi-triangular member secured to said concentric portion of said upper pole thereby dividing said upper pole into an upper portion and a lower portion, wherein said upper portion is longer than said lower portion and wherein said lower portion is substantially equal in length to said lower pole; and a hinge secured to said hollow semi-triangular member opposite of said upper pole and secured to said upper end of said lower pole.

4. The tilting pole system of claim 1, including:

a shaft having a flange near a rotating end, wherein said shaft is for supporting said utility device opposite of said rotating end; and said rotating end rotatably projecting through a cap secured to said first end of said upper pole, wherein said shaft is coaxial with said upper pole and said flange is juxtaposed to said cap.

5. The tilting pole system of claim 1, wherein said shaft includes at least two utility attachment apertures traverse to upper pole for receiving fasteners.

6. The tilting pole system of claim 4, wherein said shaft includes a plurality of alignment apertures adjacent said rotating end, wherein said alignment apertures radially project through said shaft and receive a fastener projecting through apertures within said upper pole adjacent said first end.

7. The tilting pole system of claim 3, wherein said upper pole includes a cord aperture in a position adjacent to said hollow semi-triangular member.

8. The tilting pole system of claim 1, including at least one electric outlet secured to said lower pole adjacent said lower end and electrically connected to an electric cord.

9. The tilting pole system of claim 1, including a length of conduit projecting through said concrete and connecting to an electrical outlet.

10. A tilting pole system comprising:

a lower pole having an upper end and a lower end, wherein said lower end is for securing within concrete for retaining said lower pole orthogonal to ground;

an upper pole having a first end, a second end and a concentric portion, wherein said first end is for supporting a utility device and said upper pole is a finite distance longer than said lower pole;

said concentric portion of said upper pole is pivotally attached to said upper end of said lower pole;

a securing means removably securing said second end of said upper pole to said lower end of said lower pole to retain said upper pole juxtaposed and parallel to said lower pole;

an eyelet secured to said lower end of said lower pole and another eyelet secured to said second end of said upper pole; and an elongated strap having opposing ends secured between said eyelets secured to said lower end and said second end for preventing said utility device secured to said first end of said upper pole from engaging said ground when said securing means is removed;

a cap secured to said first end of said upper pole for preventing infiltration of a lumen of said upper pole with debris;

wherein said securing means includes a securing aperture projecting through said lower pole adjacent said lower end and projecting correspondingly through said upper pole adjacent said second end; and a securing fastener removably projecting within said securing aperture.

11. The tilting pole system of claim 10, including:

a hollow semi-triangular member secured to said concentric portion of said upper pole thereby dividing said upper pole into an upper portion and a lower portion, wherein said upper portion is longer than said lower portion and wherein said lower portion is substantially equal in length to said lower pole; and a hinge secured to said hollow semi-triangular member opposite of said upper pole and secured to said upper end of said lower pole.

12. The tilting pole system of claim 11, including:

a shaft having a flange near a rotating end, wherein said shaft is for supporting said utility device opposite of said rotating end; and said rotating end rotatably projecting within said cap secured to said first end, wherein said shaft is coaxial with said upper pole and said flange is juxtaposed to said cap.

13. The tilting pole system of claim 12, wherein said shaft includes at least two utility attachment apertures traverse to upper pole for receiving fasteners.

14. The tilting pole system of claim 13, wherein said shaft includes a plurality of alignment apertures adjacent said rotating end, wherein said alignment apertures radially project through said shaft and receive a fastener projecting through apertures within said upper pole adjacent said first end.

15. The tilting pole system of claim 14, wherein said upper pole includes a cord aperture in a position adjacent to said hollow semi-triangular member.

16. The tilting pole system of claims 15, including at least one electric outlet secured to said lower pole adjacent said lower end and electrically connected to an electric cord.

17. The tilting pole system of claim 16, including a length of conduit projecting through said concrete and connecting to said electrical outlet.

* * * * *